US010408397B2

(12) United States Patent
Li et al.

(10) Patent No.: US 10,408,397 B2
(45) Date of Patent: Sep. 10, 2019

(54) TRACK HEAD AND TRACK LAMP

(71) Applicant: JIAWEI RENEWABLE ENERGY CO., LTD., Shenzhen, Guangdong (CN)

(72) Inventors: Li Li, Guangdong (CN); Gang Song, Guangdong (CN)

(73) Assignee: JIAWEI RENEWABLE ENERGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/558,128

(22) PCT Filed: Mar. 10, 2016

(86) PCT No.: PCT/CN2016/076059
§ 371 (c)(1),
(2) Date: Sep. 13, 2017

(87) PCT Pub. No.: WO2016/146018
PCT Pub. Date: Sep. 22, 2016

(65) Prior Publication Data

US 2018/0066817 A1 Mar. 8, 2018

(30) Foreign Application Priority Data

Mar. 13, 2015 (CN) ..... 2015 2 0146619 U

(51) Int. Cl.
*H01R 25/00* (2006.01)
*F21S 8/00* (2006.01)
(Continued)

(52) U.S. Cl.
CPC ..... *F21S 8/038* (2013.01); *F21V 23/002* (2013.01); *H01R 4/4809* (2013.01);
(Continued)

(58) Field of Classification Search
CPC .... H01R 33/94; H01R 25/142; H01R 4/4809; F21S 8/038; F21S 8/33; F21V 21/25; F21V 11/10; F21V 21/35; F21V 21/30
(Continued)

(56) References Cited

U.S. PATENT DOCUMENTS 5,012,251 A * 4/1991 Kennedy ..... G01S 7/026 342/173
6,244,733 B1 * 6/2001 Fong ..... F21V 21/35 362/147
(Continued)

FOREIGN PATENT DOCUMENTS

CN 2515534 10/2002
CN 201439928 4/2010
(Continued)

OTHER PUBLICATIONS

International Search Report (English and Chinese) and Written Opinion of International application No. PCT/CN2016/076059, dated May 27, 2016, 12 pages.

*Primary Examiner* — Jean F Duverne
(74) *Attorney, Agent, or Firm* — Hamre, Schumann, Mueller & Larson, P.C.

(57) ABSTRACT

The present application relates to the technical field of luminaire, and provides a track head for mounting a lamp body on a track strip, the lamp body comprises a mounting rack, the track head comprises a cassette body fixed to the mounting rack and a cover body movably mounted on the track strip, the cover body is detachably mounted on the cassette body, a plurality of first resilient sheets which are electrically connected to the lamp body are provided in the inner part of the cassette body, a plurality of second resilient sheets which are electrically connected to the first resilient sheets respectively are provided in the inner side of the cover body, a conductive structure is provided between the cover
(Continued)

body and the track strip for electrical interconnection with each other. The track head of the present application has a cassette body fixed and electrically connected to the lamp body, the cover body adapted to the track strip which can be selected and mounted to the cassette body, and the second resilient sheets are abutting against and electrically connected to the first resilient sheets, and the cover body is mounted in the track strip so as to fix the lamp body to the track strip, so that the selection of the lamp body is not restricted by the structure of the track strip and the installation and maintenance costs are reduced.

9 Claims, 3 Drawing Sheets

(51) Int. Cl.

| | |
|---|---|
| ***F21V 23/00*** | (2015.01) |
| ***H01R 4/48*** | (2006.01) |
| ***H01R 25/14*** | (2006.01) |
| ***H01R 33/94*** | (2006.01) |
| *F21V 21/30* | (2006.01) |
| *F21V 21/35* | (2006.01) |

(52) U.S. Cl.
CPC ..... *H01R 25/142* (2013.01); *H01R 33/94* (2013.01); *F21V 21/30* (2013.01); *F21V 21/35* (2013.01)

(58) Field of Classification Search
USPC ..... 439/121
See application file for complete search history.

(56) References Cited

U.S. PATENT DOCUMENTS

| | | | | |
|---|---|---|---|---|
| 6,884,095 | B1 * | 4/2005 | Tsai | H01R 25/142 439/118 |
| 2008/0106892 | A1 * | 5/2008 | Griffiths | F21V 11/10 362/223 |
| 2009/0135598 | A1 * | 5/2009 | Amos | F21S 8/033 362/249.01 |

FOREIGN PATENT DOCUMENTS

| | | |
|---|---|---|
| CN | 202266975 | 6/2012 |
| CN | 202835260 | 3/2013 |
| CN | 203521761 | 4/2014 |
| CN | 204534488 | 8/2015 |
| TW | 200181 | 2/1993 |
| WO | 2007145446 | 12/2007 |

* cited by examiner

TRACK HEAD AND TRACK LAMP

TECHNICAL FIELD

The present application relates to the technical field of lamps, and more particularly relates to a track head and track lamp.

BACKGROUND

A track lamp is a kind of common lamp, its lamp body can be moved along its track strip to change the position to suit the needs of the lighting. In a track lamp in the prior art, a lamp body is fixed with a track head, and a corresponding track strip should be fitted in the assembly and use, and in the assembly of a variety of new track lamps or the replacement of old track lamps, due to the track strip corresponding to the structure of the track head, the selectivity of the lamp body will be limited, and cost in the assembly and maintenance is increased.

SUMMARY OF THE INVENTION

One object of the present application is to provide a track head and track lamp which can overcome the problem of the prior art that the track strip must correspond to the lamp structure with a limitation in the selectivity of the lamp body and high cost in the installation and maintenance.

The present application is realized as follows: a track head is configured for mounting a lamp body on a track strip, the lamp body comprises a mounting rack, the track head comprises a cassette body fixed to the mounting rack and a cover body movably mounted on the track strip, the cover body is detachably mounted on the cassette body, a plurality of first resilient sheets for electric connection of the lamp body are provided in the cassette body, a plurality of second resilient sheets for corresponding contact and conduction of the first resilient sheets are provided on the inner side of the cover body, and a conductive structure for electrical interconnection with each other is provided between the cover body and the track strip.

Furthermore, the conducive structure comprises a plurality of contacts provided in the track strip and a plurality of third resilient sheets provided on the outside of the cover body, wherein each of the third resilient sheets are electrically connected to the second resilient sheet correspondingly.

Furthermore, the cover body is provided with a stop lug for engagement into the track strip.

Furthermore, the third resilient sheets extends outwardly along the stop lug.

Furthermore, the lamp body has three wires of an L wire, an N wire, and a ground wire, the first resilient sheets, the second resilient sheets, and the third resilient sheets are respectively numbered three correspondingly.

Furthermore, the cover body is bolted to the cassette body.

Furthermore, the cassette body is provided with a mounting cavity with its upper end open and with the first resilient sheets being arranged at its lower end side by side, the cover body is provided with a mounting portion for inserting and fitting into the mounting cavity, and the second resilient sheets are arranged at the outer end of the mounting portion side by side.

Furthermore, the lower end of the mounting cavity is provided with a plurality of slots for the insertion of the second resilient sheets, and the first resilient sheets are disposed in the slots.

Furthermore, the first resilient sheets are bent at the ends into an inclined structure that facilitates insertion of the second resilient sheets.

Compared with the prior art, the track head of the present application has a cassette body fixed to the lamp body and a replaceable cover body where the adapted cassette body can be selected for the track strip. After the cassette body and the lamp body are fixed, the first resilient sheets are electrically connected with the lamp body, and the second resilient sheets on the inside of the cover body are abutting against and electrically connected to the first resilient sheets, and are further electrically connected to the track strip by an external conductive structure so as to finally electrically connect and fix the lamp body to the track strip. It is only needed to replace the cover body and mount the cover body to the cassette body when the lamp body or the track strip need be replaced, the selection range of the lamp body is not limited, and the cost of assembly and maintenance is low.

The present application further provides a track lamp, which comprises a lamp body and the aforesaid track head. The lamp body of the present application is directly fixed with and electrically connected to the cassette body at the factory, and according to different track strips, selecting different cover bodies can achieve the assembly, with greater adaptability and lower cost of use and maintenance.

DETAILED DESCRIPTION OF THE EMBODIMENT

In order to make the purposes, technical solutions, and advantages of the present application clearer and more understandable, the present application will be further described in detail hereinafter with reference to the accompanying drawings and embodiments. It should be understood that the embodiments described herein are only intended to illustrate but not to limit the present application.

Example embodiments of the present application will now be described more fully hereinafter with reference to the accompanying drawings.

Figure 1:
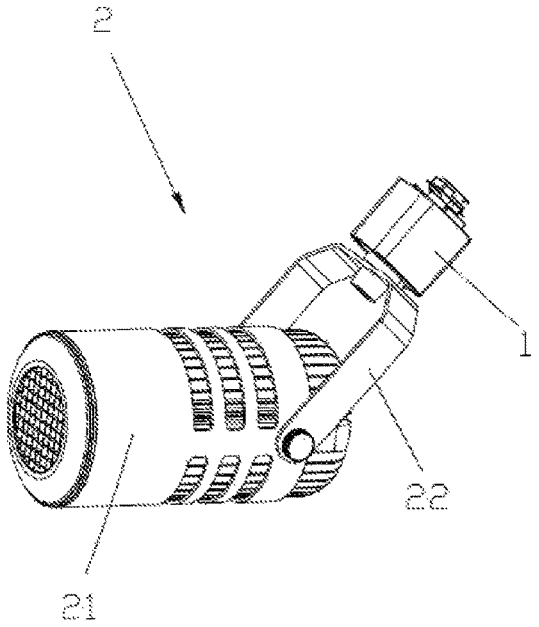
FIG. 1 shows an overall structural schematic view of a track lamp according to one embodiment of the present application.
Figure 2:
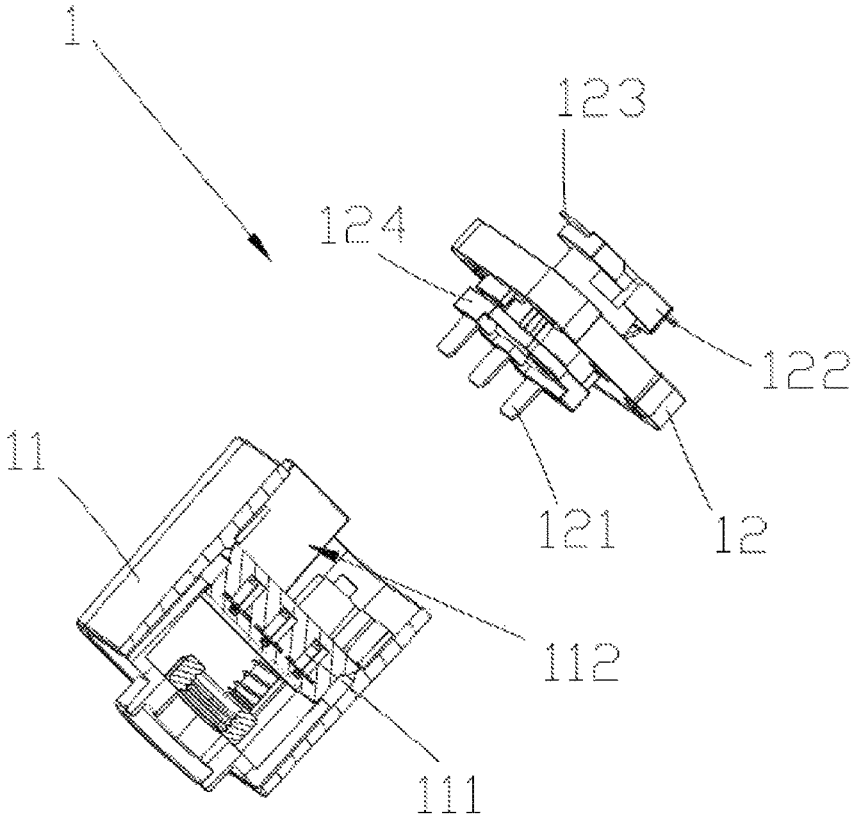
FIG. 2 shows a partially cross-sectional assembled schematic view of a track head according to one embodiment of the present application.
Figure 3:
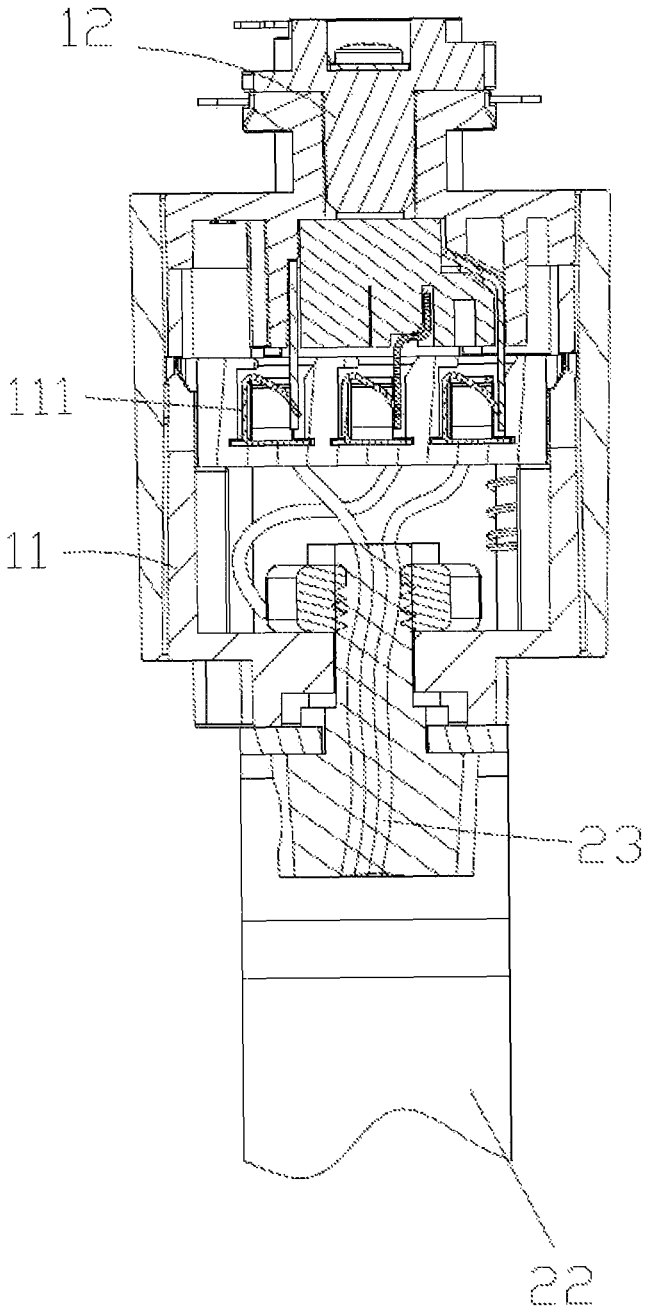
FIG. 3 shows a partially cross-sectional schematic view of a track head according to one embodiment of the present application.

The track head 1 of this embodiment can fix the lamp body 21 with the track strip (no show). As shown in FIGS. 1 to 3, the lamp body 21 comprises a mounting rack 22 and an inner circuit structure, and the circuit is provided with a corresponding wire 23 electrically connected to the outside. The track head 1 comprises a cassette body 11 and a cover body 12 which are independent of each other, and the cover body 12 is detachably mounted on the cassette body 11.

The cassette body 11 may fixed to the mounting rack 22, and a plurality of first resilient sheets 111 are disposed in the cassette body 11, the lamp 11 can be connected to the power supply through the cassette body 11 when the wires 23 of the lamp body 21 are electrically connected to the first resilient sheets 111.

The cover 12 can be mounted in the track strip, a second resilient sheets 121 is provided on the inside of the cover body 12, and a conductive structure is provided between the track strip and the cover body 12. The conductive structure can be designed according to the different track strips. The cover body 12 is mounted in the track strip and is electrically connected to the track strip, and then the cassette body 11 is mounted together with the cover body 12, at this time, the second resilient sheets 121 is electrically connected with the first resilient sheets 111 so that the lamp 21 is electrically connected to the track strip and fixed by the track head 1.

With the track head 1 of this embodiment, it is possible to design the different cover bodies 12 according to the different track strips in advance, the appropriate cover body 12 is selected during the assembly, the cassette body 11 is fixed to the lamp body 21, and then the cover body 12 adapted to the track strip is selected to be fixed with the cassette body 11, the cover body 12 is fixed to the track strip, and an electrically connection between them is ensured, so that the assembly process is completed. The replacement is easier, because the cassette body 11 is detachably fixed to the cover body 12 and is electrically connected by the resilient sheets. It is possible to optionally select a suitable lamp body and thereby enlarge the selection range of the lamp body 21, regardless of the influence of the structure of the track strip, whether the new lamp body 21 is installed or the old lamp body 21 is replaced; moreover, the cost of adaptation to the track strip is changed from changing the entire lamp body 21 to changing the cover body 12, thereby ultimately reducing the cost of installation and post-maintenance.

The cassette body 11 and the cover body 12 can be fixed in a variety of ways, such as magnetic pole adsorption, engagement of the card block and the card slot. In this embodiment, the cover body 12 is bolted to the cassette body 11 that the installation and removal can be achieved by just rotating the corresponding bolts.

As showed in FIG. 2 and FIG. 3, the cassette body 11 is provided with a mounting cavity 112 with its upper end open and with the first resilient sheets 111 being arranged at its lower end side by side. The cover body 12 is provided with a mounting portion 124 for inserting and fitting into the mounting cavity 112 for mating with the mounting process, and the second resilient sheets 121 are arranged at the outer end of the mounting portion 124 side by side. The cassette body 11 and the cover body 12 constitute a plug structure which can be fixed and electrically connected directly by plugging.

A plurality of slots for insertion of the second resilient sheets 121 are provided at the lower end of the mounting cavity 112, and the first resilient sheets 111 are disposed in the slots. The second resilient sheets 121 are inserted into the slots and connected with first resilient sheets 111 when insertion and connection of the cassette body 11 and the cover body 12 have been completed, and the first resilient sheets 111 are bent at the ends into an inclined structure that facilitates the connection between the second resilient sheets 121 and the first resilient sheets 111 after the insertion of the second resilient sheets 121, the second resilient sheets 121 are inserted into the slots and is pressed against the ends of the first resilient sheets 111 to be elastically deformed during the continuation of the insertion, the first resilient sheet 111 itself has a resilient deformation so as to has an elastic potential after the completion of the insertion which is tightly pressed against the second resilient sheet 121 to keep the two in close contact and avoid contact failure caused by vibration, deformation or the like.

A plurality of contacts for power supply are disposed in the track strip, and the design of the conductive structure may be various, such as a spring probe type, resiliently abutting against the contacts, etc. Specifically, the embodiment of the present application is shown in FIG. 2, the conductive structure comprises the third resilient sheets 123 electrically connected to the second resilient sheets 121 and may be resiliently abutted against the contacts.

In order to facilitate the engagement, the cover body 12 is provided with a stop lug 122, and the structure of the stop lug 122 corresponds to the track head 1 and varied from the difference track strips. In this present embodiment, the second resilient sheets 121 extend outwardly along the stop lug 122, and its position is also determined by the position of the contacts in the track strip, or may be provided at other positions.

Figure 4:
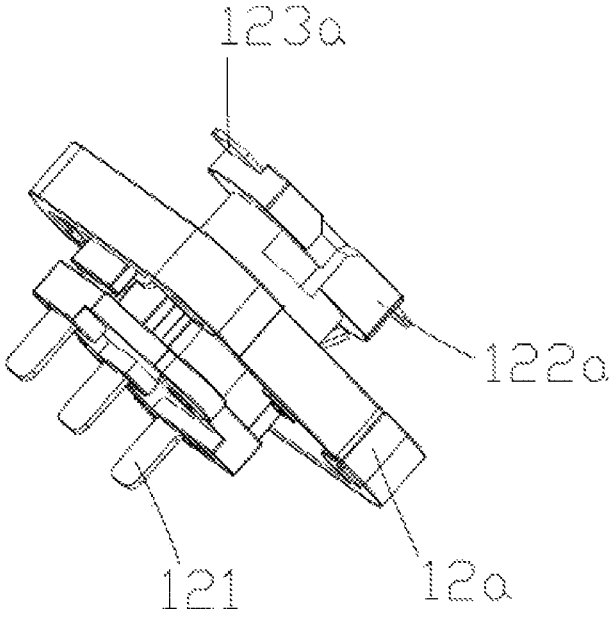
FIG. 4 shows a schematic view of a cover body in another structure according to one embodiment of the present application.

FIG. 4 shows a mechanism of another cover body 12*a* in which the structure and the direction of the stop lug 122*a* and the third resilient sheets 123*a* are different from those of the cover body 12 described above and can be adapted to other types of track strips. In the various types of track strips of the prior art, there are two kinds of track strips having the highest proportion of use, and these two correspond to the structure of the cover body 12 and the cover body 12*a*, respectively.

In this embodiment, the lamp body 21 has three wires 23 of an L wire, an N wire, and a ground wire, the first resilient sheets 111, the second resilient sheets 121, and the third resilient sheets 123 are respectively numbered three correspondingly, and in practice, the number of the resilient sheets varies from the circuit structure of the different lamp bodies 21.

As shown in FIG. 1, a track lamp 1 of the present embodiment comprises the lamp body 21, mounting rack 22, and the track head 1. When the track lamp 1 leaves the factory, the lamp body 21 and the cassette body 11 are fixed and electrically connected to each other, and a plurality of cover bodies 12 are provided to accommodate the tracks to be mounted, with greater applicability and a low installation and maintenance costs.

The aforementioned embodiments are only preferred embodiments of the present application, and are not intended for limiting the present application. Any modification, equivalent replacement, improvement, and so on, which are made within the spirit and the principle of the present application, should be included in the protection scope of the present application.

The invention claimed is:

1. A track head is configured for mounting a lamp body on a track strip, wherein the lamp body comprises a mounting rack, the track head comprises a cassette body fixed to the mounting rack and a cover body movably mounted on the track strip, the cover body is detachably mounted on the cassette body, a plurality of first resilient sheets for electric connection of the lamp body are provided in the cassette body, a plurality of second resilient sheets for corresponding contact and conduction of the first resilient sheets are provided on the inner side of the cover body, and a conductive structure for electrical interconnection with each other is provided between the cover body and the track strip, wherein the first resilient sheets are bent at the ends into an inclined structure that facilitates insertion of the second resilient sheets.

2. The track head of claim 1, wherein the conducive structure comprises a plurality of contacts provided in the track strip and a plurality of third resilient sheets provided on the outside of the cover body, wherein each of the third resilient sheets are electrically connected to the second resilient sheet correspondingly.

3. The track head of claim 2, wherein the cover body is provided with a stop lug for engagement into the track strip.

4. The track head of claim 3, wherein the third resilient sheets extends outwardly along the stop lug.

5. The track head of claim 4, wherein the lamp body has three wires of an L wire, an N wire, and a ground wire, the first resilient sheets, the second resilient sheets, and the third resilient sheets are respectively numbered three correspondingly.

6. The track head of claim 4, wherein the cover body is bolted to the cassette body.

7. The track head of claim 1, wherein the cassette body is provided with a mounting cavity with its upper end open and with the first resilient sheets being arranged at its lower end side by side, the cover body is provided with a mounting portion for inserting and fitting into the mounting cavity, and the second resilient sheets are arranged at the outer end of the mounting portion side by side.

8. The track head of claim 7, wherein the lower end of the mounting cavity is provided with a plurality of slots for the insertion of the second resilient sheets, and the first resilient sheets are disposed in the slots.

9. A track lamp, comprising a lamp body, and a track head according to claim 1.

* * * * *